US010990027B2

(12) United States Patent
Takabayashi et al.

(10) Patent No.: US 10,990,027 B2
(45) Date of Patent: Apr. 27, 2021

(54) CARRIER FOR FORMING ELECTROPHOTOGRAPHIC IMAGE, TWO-COMPONENT DEVELOPER, DEVELOPER FOR REPLENISHMENT, IMAGE FORMING APPARATUS, PROCESS CARTRIDGE, AND IMAGE FORMING METHOD

(71) Applicants: Yuuya Takabayashi, Shizuoka (JP); Junjiroh Sogame, Shizuoka (JP); Shinya Nakagawa, Shizuoka (JP); Katsuhiko Fujii, Shizuoka (JP)

(72) Inventors: Yuuya Takabayashi, Shizuoka (JP); Junjiroh Sogame, Shizuoka (JP); Shinya Nakagawa, Shizuoka (JP); Katsuhiko Fujii, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/583,654

(22) Filed: Sep. 26, 2019

(65) Prior Publication Data

US 2020/0103778 A1 Apr. 2, 2020

(30) Foreign Application Priority Data

Sep. 28, 2018 (JP) ..... JP2018-185263

(51) Int. Cl.
*G03G 9/113* (2006.01)
*G03G 9/087* (2006.01)
(Continued)

(52) U.S. Cl.
CPC ..... *G03G 9/1136* (2013.01); *G03G 9/08755* (2013.01); *G03G 9/1133* (2013.01);
(Continued)

(58) Field of Classification Search
CPC ..... G03G 9/108; G03G 9/1132; G03G 9/1139
See application file for complete search history.

(56) References Cited

U.S. PATENT DOCUMENTS 9,581,919 B1 * 2/2017 Mera ..... G03G 5/04
2011/0171573 A1 7/2011 Sakata et al.
(Continued)

FOREIGN PATENT DOCUMENTS

JP 2006-058639 3/2006
JP 2009-58892 A 3/2009
(Continued)

OTHER PUBLICATIONS

Extended European Search Report dated Jan. 28, 2020 in European Patent Application No. 19198479.8, citing documents AA, AB and AO therein, 6 pages.

*Primary Examiner* — Peter L Vajda
(74) *Attorney, Agent, or Firm* — Oblon, McClelland, Maier & Neustadt, L.L.P.

(57) ABSTRACT

A carrier for forming an electrophotographic image is provided. The carrier comprises carrier particles each comprising a core particle and a coating layer. The coating layer comprises a coating resin and inorganic particles comprising chargeable particles A and conductive particles B. The amount of the inorganic particles is from 195 to 350 parts by mass with respect to 100 parts by mass of the coating resin. The carrier particles consist of small carrier particles (D1≤25 μm), medium carrier particles (25 μm<D2≤38 μm), and large carrier particles (38 μm<D3). A constituent element variation, that is a ratio of an amount of a constituent element of the inorganic particles contained in the coating layer of the small carrier particles to an amount of the same constituent element of the inorganic particles contained in the coating layer of the medium carrier, is from −10.0% to 10.0%.

11 Claims, 3 Drawing Sheets

(51) Int. Cl.
*G03G 15/08* (2006.01)
*G03G 21/18* (2006.01)

(52) U.S. Cl.
CPC ..... *G03G 9/1139* (2013.01); *G03G 15/08* (2013.01); *G03G 21/1814* (2013.01)

(56) References Cited

U.S. PATENT DOCUMENTS

| | | | | |
|---|---|---|---|---|
| 2017/0185000 | A1 | 6/2017 | Nagayama et al. | |
| 2017/0205721 | A1 | 7/2017 | Murasawa et al. | |
| 2017/0269497 | A1 | 9/2017 | Murasawa et al. | |
| 2018/0113393 | A1 | 4/2018 | Seki et al. | |
| 2018/0120724 | A1* | 5/2018 | Sakata ..... | G03G 9/1139 |
| 2018/0267421 | A1 | 9/2018 | Takii et al. | |
| 2019/0018331 | A1 | 1/2019 | Takii et al. | |

FOREIGN PATENT DOCUMENTS

| | | |
|---|---|---|
| JP | 2011-145397 | 7/2011 |
| JP | 2011-209678 | 10/2011 |
| JP | 2016-212254 | 12/2016 |
| JP | 2017-167387 | 9/2017 |
| JP | 2018-155932 | 10/2018 |

* cited by examiner

CARRIER FOR FORMING ELECTROPHOTOGRAPHIC IMAGE, TWO-COMPONENT DEVELOPER, DEVELOPER FOR REPLENISHMENT, IMAGE FORMING APPARATUS, PROCESS CARTRIDGE, AND IMAGE FORMING METHOD

CROSS-REFERENCE TO RELATED APPLICATIONS

This patent application is based on and claims priority pursuant to 35 U.S.C. § 119(a) to Japanese Patent Application No. 2018-185263, filed on Sep. 28, 2018, in the Japan Patent Office, the entire disclosure of which is hereby incorporated by reference herein.

BACKGROUND

Technical Field

The present disclosure relates to a carrier for forming an electrophotographic image, a two-component developer, a developer for replenishment, an image forming apparatus, a process cartridge, and an image forming method.

Description of the Related Art

In an electrophotographic image forming process, an electrostatic latent image is formed on an electrostatic latent image bearer (e.g., photoconductive substance), and a charged toner is attached to the electrostatic latent image to form a toner image. The toner image is then transferred onto a recording medium and fixed thereon, thereby outputting an image. In recent years, electrophotographic technology for copiers and printers has rapidly expanded from monochrome printing to full-color printing, and the market of full-color printing is still expanding.

In a typical full-color image forming processes, three color toners including yellow, magenta, and cyan toners or four color toners further including black toner in addition to the three color toners are stacked to reproduce all possible colors. Therefore, to obtain a vivid full-color image with excellent color reproducibility, the surface of the fixed toner image should be smoothened to reduce light scattering. For this reason, many of conventional full-color copiers have achieved high-gloss images by increasing the amount of toner attached to an electrostatic latent image to smooth the toner image. This undesirably causes the deteriorated toner (or spent toner) to adhere to the surface of a carrier during a long-term printing. In particular, the spent toner degrades the carrier to cause an increase of resistance and a decrease of charging ability. When the charging ability of the carrier is lowered, toner scattering occurs to contaminate the inside of the apparatus, which causes a malfunction such as erroneous detection by sensors.

In the field of production printing where the market is expanding lately, higher image quality than ever has been demanded. The carrier is subjected to a strong stress inside the developing device in high-speed development, and the coating resin of the carrier wears to expose the core material. As a result, the carrier is transferred onto the electrostatic latent image bearer. This phenomenon is generally called "carrier deposition". The carrier deposition causes an undesirable phenomenon in which white voids (where toner partly absent like white dots) appear at the edge and central portions of the image. Measures against this phenomenon have more severely demanded in recent years.

On the other hand, carrier deposition can be prevented by designing the carrier to have a high level of resistance from the initial stage so that the resistance is maintained at a high level. In this case, however, the surface charge of the carrier cannot be appropriately leaked immediately after image development, which may cause an undesirable phenomenon in which the edge portion of a halftone image becomes less dense.

On the other hand, in recent years, toners have become fixable at lower temperatures to reduce power consumption and the printing speed has been increased, so that adhesion of the spent toner to the carrier is more likely to occur. Furthermore, toners tend to contain many additives in response to the demand for higher image quality. However, the spent additives adhere to the carrier to cause a decrease of the amount of toner charge and a decrease of the resistance to toner scattering and background fouling. In addition, since the added amount of charged particles has been reduced to make toners to be fixable at lower temperatures, the supplied toner cannot be sufficiently mixed with the developer and cannot be charged, thus causing toner scattering.

SUMMARY

In accordance with some embodiments of the present invention, a carrier for forming an electrophotographic image is provided. The carrier comprises carrier particles each comprising a core particle and a coating layer coating the core particle. The coating layer comprises a coating resin and inorganic particles comprising chargeable particles A and conductive particles B. The amount of the inorganic particles is from 195 to 350 parts by mass with respect to 100 parts by mass of the coating resin. The carrier particles consist of: small carrier particles having a particle diameter of D1, where $D1 \leq 25$ μm is satisfied; medium carrier particles having a particle diameter of D2, where $25\ \mu m < D2 \leq 38$ μm is satisfied; and large carrier particles having a particle diameter of D3, where $38\ \mu m < D3$ is satisfied. A constituent element variation, that is a ratio of an amount of a constituent element of the inorganic particles contained in the coating layer of the small carrier particles having a particle diameter of D1 to an amount of the same constituent element of the inorganic particles contained in the coating layer of the medium carrier particles having a particle diameter of D2, is within a range of from −10.0% to 10.0%.

In accordance with some embodiments of the present invention, a two-component developer is provided. The two-component developer comprises the above-described carrier and a toner.

In accordance with some embodiments of the present invention, a developer for replenishment is provided. The developer comprises the above-described in an amount of 1 part by mass and a toner in an amount of from 2 to 50 parts by mass or more.

In accordance with some embodiments of the present invention, an image forming apparatus is provided. The image forming apparatus includes: an electrostatic latent image bearer; a charger configured to charge the electrostatic latent image bearer; an irradiator configured to form an electrostatic latent image on the electrostatic latent image bearer; a developing device containing the above-described two-component developer, configured to develop the electrostatic latent image formed on the electrostatic latent image bearer with the two-component developer to form a toner image; a transfer device configured to transfer the toner image formed on the electrostatic latent image bearer onto a recording medium; and a fixing device configured to fix the toner image on the recording medium.

In accordance with some embodiments of the present invention, a process cartridge is provided. The process cartridge includes: an electrostatic latent image bearer; a charger configured to charge a surface of the electrostatic latent image bearer; a developing device containing the above-described two-component developer, configured to develop an electrostatic latent image formed on the electrostatic latent image bearer with the two-component developer; and a cleaner configured to clean the electrostatic latent image bearer.

In accordance with some embodiments of the present invention, an image forming method is provided. The image forming method includes the processes of: forming an electrostatic latent image on an electrostatic latent image bearer; developing the electrostatic latent image formed on the electrostatic latent image bearer with the above-described two-component developer to form a toner image; transferring the toner image formed on the electrostatic latent image bearer onto a recording medium; and fixing the toner image on the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
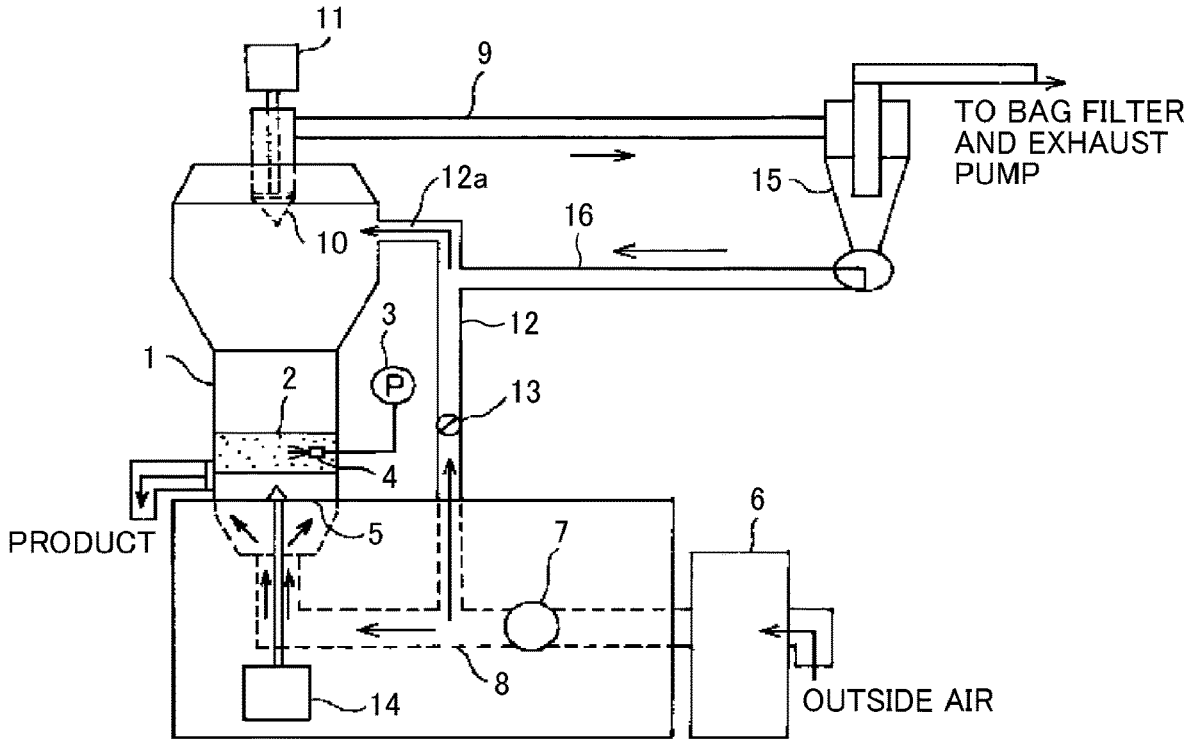
FIG. 1 is a cross-sectional view of a fluidized bed coating apparatus used for production of the carrier according to an embodiment the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with an embodiment of the present invention, a carrier for forming an electrophotographic image is provided that has the controlled resistance and charge for achieving the required level of image quality in the field of production printing and that does not cause undesirable phenomena such as carrier deposition even when a large amount of inorganic particles is introduced for the purpose of imparting sufficient charge holding ability while adjusting the resistance to be within a low resistance region.

The carrier according to an embodiment of the present invention is described in detail below.

The carrier for forming an electrophotographic image according to according to an embodiment of the present invention comprises carrier particles each comprising a core particle and a coating layer coating the core particle. The coating layer comprises a coating resin and inorganic particles comprising chargeable particles A and conductive particles B. The amount of the inorganic particles is from 195 to 350 parts by mass with respect to 100 parts of the coating resin. The carrier particles consist of: small carrier particles having a particle diameter of D1, where $D1 \leq 25$ μm is satisfied; medium carrier particles having a particle diameter of D2, where 25 μm$<D2\leq 38$ μm is satisfied; and large carrier particles having a particle diameter of D3, where 38 μm$<D3$ is satisfied. A constituent element variation is within a range of from −10.0% to 10.0%, where the constituent element variation is a ratio of an amount of a constituent element of the inorganic particles contained in the coating layer of the small carrier particles having a particle diameter of D1 to an amount of the same constituent element of the inorganic particles contained in the coating layer of the medium carrier particles having a particle diameter of D2.

According to an embodiment of the present invention, the coating layer contains at least chargeable particles A and conductive particles B. To adjust the resistance to be within a low resistance region while ensuring sufficient charge holding ability, two types of particles should be introduced: the chargeable particles A having high chargeability with toner and the conductive particles B having conductivity. In addition to the conductive particles B, carbon black may be further introduced that has an excellent resistance adjusting function. By making the amount of carbon black gradually reduced toward the surface layer, the amount of carbon black contained in the coating component released from the carrier, upon scraping off of the coating layer, is reduced. As a result, the occurrence of color stains on the toner can be prevented. In response to a concern for an increase of the electrical resistance near the surface layer due to the reduction of the amount of carbon black, the amount of the conductive particles B is made increased toward the surface layer where the amount of carbon black is small. As a result, the electrical resistance of the surface layer side becomes equivalent to that of the deep layer side having a high carbon black concentration.

According to an embodiment of the present invention, the carrier particles consist of: small carrier particles having a particle diameter of D1, where $D1 \leq 25$ μm is satisfied (hereinafter the small carrier particles may be referred to as "carrier particles D1" for simplicity); medium carrier particles having a particle diameter of D2, where 25 μm<D2≤38 μm is satisfied (hereinafter the medium carrier particles may be referred to as "carrier particles D2" for simplicity); and large carrier particles having a particle diameter of D3, where 38 μm<D3 is satisfied (hereinafter the large carrier particles may be referred to as "carrier particles D3" for simplicity). At this time, the constituent element variation in the inorganic particles contained in the carrier particles D1 with respect to the inorganic particles contained in the carrier particles D2 varies within a range of from −10.0% to 10.0%. When two types of particles, i.e., the chargeable particles A and the conductive particles B, are contained together, the chargeable particles A inhibit conductivity. In this case, to adjust their resistances to the same level, the introduction amount of the conductive particles B is made larger than that in the case where the chargeable particles A are not introduced. When the conductive particles B are not chargeable, the amount of chargeable components on the outermost layer of the carrier is small. Therefore, as the amount of the conductive particles B is increased, the above-described charge holding ability is lowered. Thus, in attempting to impart sufficient charge holding ability while adjusting the resistance to be within a low resistance region, the total amount of the chargeable particles A and conductive particles B becomes very large, and the volume ratio of these inorganic particles occupying the coating layer will increase.

Such a coating resin layer may be formed by a coating process using a fluidized bed. In this process, a resin liquid is sprayed from a spray coating nozzle while the core particles are swirled in the air by floating gas. However, the resulting coating resin film has variation in film thickness and amount of inorganic particles contained therein depending on the particle size of the core particles. Core particles for the carrier particles D1 having a small particle diameter are light and therefore likely to swirl at the upper part of the fluidized bed in the height direction. Core particles for the carrier particles D3 are heavy and therefore likely to float at the lower part of the fluidized bed. Since the resin liquid is sprayed in a fixed direction from the nozzle disposed at a fixed point, the contact efficiency with the sprayed liquid and the size of the liquid droplets to be contacted differ depending on the swivel position of the core particles. As a result, the coating resin films formed in the carrier particles D1, D2, and D3 are made different. With respect to the carrier particles D2 having a medium particle diameter, the core particles thereof swirl in the vicinity of the nozzle and get coated with the resin liquid that has been sheared into uniform small-size droplets by the nozzle, so that a uniform coating resin film is formed. With respect to the carrier particles D1, the core particles thereof swirl in the upper part of the fluidized bed, and the film thickness of the resulting coating resin film and the amount of inorganic particles contained in the film are larger than those of the carrier particles D2. This is because the resin liquid that has been sheared into small droplets by the nozzle gets gathered into huge and non-uniform droplets during its ascension with the floating air. Non-uniformity of the resulting coating resin film can be improved to some extent by controlling the floating condition of the core particles in the fluidized bed. As the total quantity of airflow to be introduced is increased, the core particles for the carrier particles D1, D2, and D3 get more actively move in the height direction and swirl while being mixed with each other, thereby improving non-uniformity in coating. The swirling behavior of the core particles also changes depending on the spraying direction of the spray nozzle. Non-uniformity in coating can be more reduced when the spraying direction is from top to bottom rather than when the spraying direction is horizontal to the swirling direction of the core particles because an airflow is formed in the height direction. Major adjustment factors for reducing non-uniformity in coating include the total quantity of airflow such as supply air and secondary air. It is preferable that the quantity of airflow be increased. Non-uniformity in coating can be most reduced when the total quantity of airflow is adjusted, the quantity ratio between the supply air and the secondary air is adjusted, and further the spraying direction of the spray nozzle is from top to bottom.

The ratio (Mp/Mq) of a quantity Mp ($m^3$/min) of the supply air to a quantity Mq ($m^3$/min) of the secondary air is preferably in the range of from 1.80 to 1.90.

It has been confirmed that non-uniformity of the resulting coating resin film increases as the total amount of inorganic particles contained in the coating resin increases. In view of this, it has been found that, when the ratio (Mp/Mq) in quantity of airflow is increased to 1.80 or more, the floating condition of the core particles in the fluidized bed can be controlled (i.e., the movement in the height direction is activated) to improve non-uniformity in coating. In addition, the constituent element variation can be reduced to 10% or less even when the carrier contains a large amount of inorganic particles. When the ratio in quantity of airflow (Mp/Mq) is 1.90 or less, the fluidized bed can be prevented from flying up too high and the core particles and a large amount of the coated carrier particles are prevented from being discharged from an exhaust pipe, thereby preventing a decrease of yield.

An example of a fluidized bed coating apparatus is illustrated in FIG. 1. This coating apparatus includes a granulation cylinder 1 that forms a powder fluidized bed (carrier fluidized bed) 2, a drying air supplier that supplies drying air into the granulation cylinder 1 from below, a liquid pump 3 and a spray nozzle 4 that spray a resin liquid into the granulation cylinder 1, and a cyclone dust collector 15 as a classier that separates and collects powder having a relatively large particle size in the air discharged from the granulation cylinder 1. The drying air supplier includes a blower 7, a humidity controller 6 disposed on the suction side of the blower 7, and an air heater, an air supply pipe 8, and a secondary air inflow pipe 12 each disposed on the discharge side of the blower 7. The air supply pipe 8 connects the humidity controller 6, the blower 7, the air heater, and a lower portion of the granulation cylinder 1 in this order. The secondary air inflow pipe 12 connects an outlet portion of the air heater disposed in the air supply pipe 8 and the upper space of the granulation cylinder 1. A collected powder discharge portion of the cyclone dust collector 15 is connected to the secondary air inflow pipe 12 via a collection pipe 16 provided with a powder transport mechanism (e.g., screw conveyor).

The apparatus further includes a rotary disc 5, an exhaust pipe 9, a classification blade 10, a drive motor 11, a secondary air inflow portion 12*a*, an airflow quantity control valve 13, and a drive motor 14.

A powder fluidized bed (i.e., a state in which core particles in the fluidized bed are floating) is formed by the air supplied from the lower part of the apparatus. The spray nozzle disposed inside the powder fluidized bed sprays droplets of the coating liquid (resin liquid) to the core particles to coat the core particles. To prevent the carrier particles from flying up too much, this coating apparatus supplies the secondary air from the upper part of the apparatus. The secondary air descends along the inner wall of the apparatus to prevent flying up of the carrier particles.

In FIG. 1, the direction of spraying of the resin liquid is the same as the traveling direction of the material to be coated. However, in manufacturing the carrier according to an embodiment of the present invention, it is preferable that the resin liquid is sprayed in the direction from top to bottom.

According to an embodiment of the present invention, the constituent element variation in the inorganic particles contained in the carrier particles D1 with respect to the inorganic particles contained in the carrier particles D2 is 10.0% or less. When the constituent element variation exceeds 10.0%, it means that the carrier particles D1 contain more inorganic particles in the coating resin film than the carrier particles D2 that has the average film composition. Similarly, the ratios of other coating resin components such as a resin are also larger at the same rate. Therefore, the carrier particles D1 contain more inorganic particles and have a larger film thickness than the carrier particles D2. Because the core particles of the carrier particles D1 having a small particle diameter have a small volume, the magnetization of the carrier particles D1 is weaker than that of the carrier particles D2 and D3. The magnetization thereof is further lowered for the reasons described above, and therefore the carrier particles D1 are unlikely to be held on a developing sleeve. In addition, the interface between the binder resin and the particles increases, and minute dielectric breakdown occurs at the interface. Therefore, the charges for development are easily injected into the carrier. As a result, carrier deposition significantly occurs in the initial stage of printing that is free of scraping of the coating resin film.

In addition, according to an embodiment of the present invention, the constituent element variation in the inorganic particles contained in the carrier particles D1 with respect to the inorganic particles contained in the carrier particles D2 is −10.0% or more. When the constituent element variation falls below −10.0%, the resulting coating resin film is too thin. Therefore, as the coating resin film gets scraped off due to printing stress over time, the core particle gets partially exposed and the resistance is reduced, thus causing carrier deposition.

Accordingly, the constituent element variation in the inorganic particles contained in the carrier particles D1 with respect to the inorganic particles contained in the carrier particles D2 varies within a range of from −10.0% to 10.0%. More preferably, the constituent element variation varies within a range of from −5% to 5% so that the coating resin layer composition becomes closer to that of the carrier particles D2 in which a uniform film is formed. In this case, the occurrence of carrier deposition in solid portions can be prevented at the initial stage of printing, and a decrease of the resistance due to scraping of the coating resin film over time can be prevented.

To obtain a carrier in which "the constituent element variation in the inorganic particles contained in the carrier particles D1 with respect to the inorganic particles contained in the carrier particles D2 varies within a range of from −10.0% to 10.0%", unevenness coating should be avoided which occurs when each core particle is present in a different area in the fluidized bed layer (i.e., the region where the core particles swirl in the fluidized bed) depending on the particle size due to the influence of gravity. Thus, to prevent the core particles from separately swirling at different positions (heights), the quantity of airflow and the spraying direction should be adjusted so as to form upward and downward airflows for mixing the core particles with each other.

The constituent element variation in the inorganic particles contained in the carrier particles D1 with respect to the inorganic particles contained in the carrier particles D2 can be confirmed by a known method. For example, the intensity of constituent elements of the inorganic particles contained in the carrier can be determined by a fluorescent X-ray measurement apparatus. In the present disclosure, a fluorescent X-ray measurement apparatus ZSX-100e (manufactured by Rigaku Corporation) is used. This apparatus has an irradiation diameter of 30 mm and a penetration depth of from 1 nm to several micrometers and detects information from the surface to the core of the carrier. The element to be detected is not particularly limited. However, it is desirable to acquire the intensity of an element derived from the main component of the inorganic particles in either the chargeable particles A or the conductive particles B.

Specifically, the carrier is placed on a 38-μm mesh and sieved by the 38-μm mesh with a 25-μm mesh disposed below in an overlapping manner. The carrier particles are classified into carrier particles D1 that have passed through the 25-μm mesh, carrier particles D2 remaining on the 25-μm mesh, and carrier particles D3 that have not passed through the 38-μm mesh. The carrier particles are evenly sprinkled on a circular adhesive sheet (manufactured by LINTEC Corporation, having a diameter 45 mm) to be attached to the sticky surface. The sheet is then flicked to remove the extra carrier particles attached. The amount of carrier particles attached to the sticky surface is adjusted to 0.10 to 0.12 g. Such a specimen is prepared for each of the carrier particles D1 and the carrier particles D2. The specimen is then set to a sample holder and irradiated with X-rays using an X-ray generator having a maximum output of 4 kW, an end-window-type (Rh) X-ray tube, a primary filter made of Zr, a wavelength-dispersion-type analysis method, and PR gas (consisting of 10% of $CH_4$ and 90% of Ar), under the output of 50 kV, 30 mA (the output varies depending on the type of element to be detected), to measure a specific element. The detected spectrum is corrected with the standard sample, and the intensity (kcps) is calculated. The ratio of the calculated intensity of a constituent element in the inorganic particles in the carrier particles D1 to that of the constituent element in the inorganic particles in the carrier particles D2 is calculated.

The coating layer contains the inorganic particles in an amount of from 195 to 350 parts by mass with respect to 100 parts by mass of the coating resin. When the amount of the inorganic particles exceeds 350 parts by mass, the amount of binder resin that embeds the particles in the carrier surface becomes insufficient, making the surface brittle. When such a carrier with a brittle surface is used, the inorganic particles are detached from the surface in the initial stage of printing and the carrier resistance is lowered, thus causing carrier deposition.

When the amount of the inorganic particles falls below 195 parts by mass, hard components of the coating film are lost and the coating film gets easily scraped due to printing stress. As a result, the core particle gets exposed over time to lower the carrier resistance. Moreover, the chargeable particles A cannot be exposed in sufficient amounts at the surface of the carrier, thereby reducing the charge with time during printing. For these reasons, the coating layer contains the inorganic particles in an amount of from 195 to 350 parts by mass, more preferably from 220 to 320 parts by mass, with respect to 100 parts by mass of the coating resin.

The ratio of the inorganic particles to the coating resin in the coating layer can be determined from the prescription amount, if it is available.

When the prescription is unknown, the ratio can be determined by a fluorescent X-ray measurement as follows.

An intensity A (kcps) of an element derived from the main component of the coating resin in the coating layer and an intensity B (kcps) of an element derived from the main component of the inorganic particles are respectively measured, and a ratio C of the intensity B to the intensity A is determined. Multiple carriers are prepared whose total amount of inorganic particles with respect to 100 parts by mass of the coating resin in the coating layer is known, and the ratio C of B to A is determined in advance for each carrier. A calibration curve is created for determining the ratio C by the total amount of inorganic particles with respect to 100 parts by mass of the coating resin. For a carrier whose prescription is unknown, the total amount of inorganic particles with respect to 100 parts by mass of the coating resin can be determined from the ratio C obtained by a fluorescent X-ray measurement with reference to the above-prepared calibration curve.

The amount of the chargeable particles A is preferably from 100 to 180 parts by mass for preventing toner scattering, and accordingly, the amount of the conductive particles B is preferably from 95 to 170 parts by mass for adjusting the resistance to be within a low resistance region, with respect to 100 parts by mass of the coating resin.

Preferably, the chargeable particles A are inorganic particles comprising at least one member selected from barium sulfate, magnesium oxide, magnesium hydroxide, and hydrotalcite. When a negatively-chargeable toner is used, the charge imparting ability is stabilized for an extended period of time by selecting a positively-chargeable material. In particular, barium sulfate is preferable for its high charging ability for negatively-chargeable toners and white color that exerts little influence on the color of the toner even when it is detached from the coating resin.

Further, the chargeable particles A preferably have an equivalent circle diameter of from 400 to 900 nm. Such chargeable particles A can be present in a convex state on the surface of the carrier coating layer, which ensures toner charging ability. To ensure reliable charging ability and developing ability, the equivalent circle diameter of the chargeable particles A is more preferably 600 nm or more. Further, when the equivalent circle diameter of the chargeable particles A is 900 nm or less, the particle diameter of the chargeable particles A will not be too large with respect to the thickness of the coating film. Therefore, the chargeable particles A are sufficiently retained in the binder resin and hardly detached from the coating resin film, which is preferable.

As the conductive particles B, any known or new material having a powder specific resistance of 200 Ω·cm or less can be used. By the use of the chargeable particles A, the surface of the coating layer containing the conductive particles B is prevented from being scraped. However, the coating layer gets scraped little by little through a long-term use. At that time, to minimize toner color contamination caused by the conductive particles B detached from the coating layer or the conductive particles B contained in the detached coating layer, it is preferable that the conductive particles B be close to white or colorless as possible. Examples of materials having good color and conductive function include, but are not limited to, tin oxides doped with tungsten, indium, phosphorus, or an oxide of any of these substances. These tin oxides can be used as they are or provided to the surfaces of base particles. As the base particles, either known or new material can be used. Examples thereof include, but are not limited to, aluminum oxide and titanium oxide.

Further, the conductive particles B preferably have an equivalent circle diameter of from 600 to 1,000 nm. When the equivalent circle diameter is 600 nm or more, the particle diameter is not too small, and the carrier resistance can be efficiently reduced. When the equivalent circle diameter is 1,000 nm or less, the conductive particles B are less likely to be detached from the surface of the coating layer. As the conductive particles B that have the resistance adjusting function are less likely to be detached, the carrier resistance is less likely to vary and the reliability of image quality is improved.

The coating resin of the carrier may include a silicone resin, an acrylic resin, or a combination thereof. Acrylic resins have high adhesiveness and low brittleness and thereby exhibit superior wear resistance. At the same time, acrylic resins have a high surface energy. Therefore, when an acrylic resin is used in combination with a toner which easily gets spent, the spent toner components may be accumulated on the acrylic resin to cause a decrease of the amount of charge. This problem can be solved by using a silicone resin in combination with the acrylic resin. This is because silicone resins have a low surface energy and the spent toner components are less likely to adhere thereto, which prevents accumulation of the spent toner components that causes detachment of the coating film. At the same time, silicone resins have low adhesiveness and high brittleness and therefore the wear resistance thereof is poor. When the coating film contains a good combination of the acrylic resin and the silicone resin, the spent toner is less likely to adhere thereto and the wear resistance thereof is remarkably improved. This is because silicone resins have a low surface energy and the spent toner components are less likely to adhere thereto, which prevents accumulation of the spent toner components that causes detachment of the coating film.

In the present disclosure, silicone resins refer to all known silicone resins. Examples thereof include, but are not limited to, straight silicone resins consisting of organosiloxane bonds, and modified silicone resins (e.g., alkyd-modified, polyester-modified, epoxy-modified, acrylic-modified, and urethane-modified silicone resins). Specific examples of the straight silicone resins include, but are not limited to, commercially-available products such as KR271, KR255, and KR152 (available from Shin-Etsu Chemical Co., Ltd.); and SR2400, SR2406, and SR2410 (available from Dow Corning Toray Co., Ltd.). The silicone resin can be used alone or in combination with other components such as a cross-linking component and a charge controlling component. Specific examples of the modified silicone resins include, but are not limited to, commercially-available products such as KR206 (alkyd-modified), KR5208 (acrylic-modified), ES1001N (epoxy-modified), and KR305 (urethane-modified) (available from Shin-Etsu Chemical Co., Ltd.); and SR2115 (epoxy-modified) and SR2110 (alkyd-modified) (available from Dow Corning Toray Co., Ltd.).

In the present disclosure, acrylic resins refer to all known resins containing an acrylic component and are not particularly limited. The acrylic resin can be used alone or in combination with at least one cross-linking component. Specific examples of the cross-linking component include, but are not limited to, an amino resin and an acidic catalyst. Specific examples of the amino resin include, but are not limited to, guanamine resin and melamine resin. The acidic catalyst here refers to all materials having a catalytic action. Specific examples thereof include, but are not limited to, those having a reactive group of a completely alkylated type, a methylol group type, an imino group type, or a methylol/imino group type.

Preferably, the carrier according to an embodiment of the present invention has a volume average particle diameter of from 25 to 38 μm. When the volume average particle diameter is 25 μm or more, carrier deposition does not occur. When the volume average particle diameter is 38 μm or less, reproducibility of image details does not deteriorate and a fine image can be formed.

The volume average particle diameter can be measured by a particle size analyzer MICROTRAC HRA9320-X100 (manufactured by Nikkiso Co., Ltd.).

Figure 2:
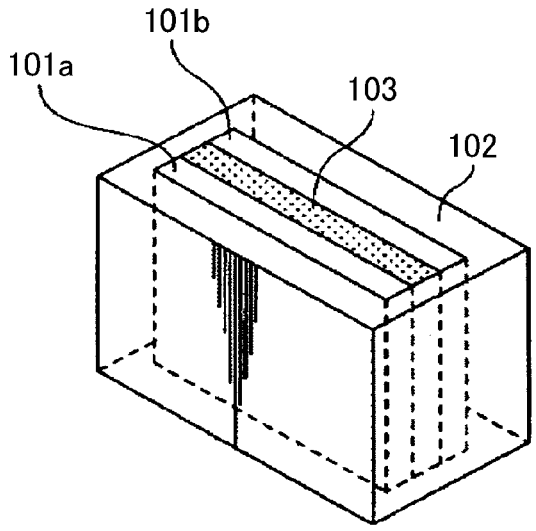
FIG. 2 is a diagram illustrating a cell used to measure the volume resistivity of a carrier.

Preferably, the carrier according to an embodiment of the present invention has a volume resistivity of from 8 to 16 (Log Ω·cm). When the volume resistivity is 8 (Log Ω·cm) or more, carrier deposition does not occur in non-image portions. When the volume resistivity is 16 (Log Ω·cm) or less, the edge effect does not become an unacceptable level. The volume resistivity can be measured using a cell illustrated in FIG. 2. Specifically, the cell comprises a fluororesin container 102 in which electrodes 101*a* and 101*b* each having a surface area of 2.5 cm×4 cm are accommodated with a distance of 0.2 cm therebetween. The cell is filled with a carrier 103 and thereafter subjected to tapping 10 times under the condition that the falling height is 1 cm and the tapping speed is 30 times per minute. Next, a direct-current voltage of 1,000 V is applied to between the electrodes 101*a* and 101*b*, and 30 seconds later, a resistance value r (Ω) is measured by a HIGH RESISTANCE METER 4329A (manufactured by Yokogawa-Hewlett-Packard, Ltd.). The volume resistivity (Ω·cm) is calculated from the following formula.

$$r\times(2.5\times4)/0.2$$

When the coating resin comprises a silicone resin, an acrylic resin, or a combination thereof, it is possible to increase film strength by cross-linking silanol groups by causing a condensation by a polycondensation catalyst.

Examples of the polycondensation catalyst include titanium-based catalysts, tin-based catalysts, zirconium-based catalysts, and aluminum-based catalysts. Among these catalysts, titanium-based catalysts have superior properties, and titanium diisopropoxybis(ethyl acetoacetate) is most preferable. It is considered that this catalyst effectively accelerates condensation of silanol groups and is hardly to be deactivated.

Preferably, the composition for the coating layer contains a silane coupling agent, for reliably dispersing particles.

Specific examples of the silane coupling agent include, but are not limited to, γ-(2-aminoethyl)aminopropyl trimethoxysilane, γ-(2-aminoethyl)aminopropylmethyl dimethoxysilane, γ-methacryloxypropyl trimethoxysilane, N-β-(N-vinylbenzylaminoethyl)-γ-aminopropyl trimethoxysilane hydrochloride, γ-glycidoxypropyl trimethoxysilane, γ-mercaptopropyl trimethoxysilane, methyl trimethoxysilane, methyl triethoxysilane, vinyl triacetoxysilane, γ-chloropropyl trimethoxysilane, hexamethyl disilazane, γ-anilinopropyl trimethoxysilane, vinyl trimethoxysilane, octadecyldimethyl[3-(trimethoxysilyl)propyl] ammonium chloride, γ-chloropropylmethyl dimethoxysilane, methyl trichlorosilane, dimethyl dichlorosilane, trimethyl chlorosilane, allyl triethoxysilane, 3-aminopropylmethyl diethoxysilane, 3-aminopropyl trimethoxysilane, dimethyl diethoxysilane, 1,3-divinyltetramethyl disilazane, and methacryloxyethyldimethyl(3-trimethoxysilylpropyl) ammonium chloride. Two or more of these materials can be used in combination.

Specific examples of commercially-available silane coupling agents include, but are not limited to, AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (available from Dow Corning Toray Co., Ltd.).

Preferably, the proportion of the silane coupling agent to the silicone resin is from 0.1% to 10% by mass. When the proportion of the silane coupling agent is 0.1% by mass or more, the adhesion strength between the core particles/conductive particles and the silicone resin does not deteriorate, and the coating layer does not fall off during a long-term use. When the proportion is 10% by mass or less, toner filming does not occur during a long-term use.

According to an embodiment of the present invention, the core particles are not particularly limited as long as they are magnetic materials. Specific examples thereof include, but are not limited to: ferromagnetic metals such as iron and cobalt; iron oxides such as magnetite, hematite, and ferrite; various alloys and compounds; and resin particles in which these magnetic materials are dispersed. Among these materials, Mn ferrite, Mn—Mg ferrite, and Mn—Mg—Sr ferrite are preferable because they are environmentally-friendly.

The volume average particle diameter of the core particles of the carrier is not particularly limited. For preventing the occurrence of carrier deposition and carrier scattering, the volume average particle diameter is preferably 20 μm or more. For preventing the production of abnormal images (e.g., stripes made of carrier particles) and deterioration of image quality, the volume average particle diameter is preferably 100 μm or less. In particular, core particles having a volume average particle diameter of from 25 to 38 μm can meet a recent demand for higher image quality.

Preferably, the coating layer has an average film thickness of 0.50 μm or more. When the average film thickness is 0.50 μm or more, the coating film is free of defective portion and can reliably retain particles.

A developer for forming an electrophotographic image according to an embodiment of the present invention contains the carrier according to an embodiment of the present invention.

A two-component developer according to an embodiment of the present invention contains the carrier according to an embodiment of the present invention and a toner. Preferably, the toner is a negatively-chargeable toner.

The toner contains a binder resin and a colorant. The toner may be a toner for either black-and-white printing or color printing. The toner may further contain a release agent so that the toner can be used in oilless fixing systems in which the fixing roller is free of application of toner adherence preventing oil. Although such a toner is likely to cause filming, the carrier according to an embodiment of the present invention can prevent the occurrence of filming, and the two-component developer according to an embodiment of the present invention can provide high-quality images for an extended period of time. Color toners, particularly yellow toners, generally have a drawback that the color is contaminated with the coating layer scraped off from the carrier. The developer according to an embodiment of the present invention can prevent such a contamination of the color.

The toner can be produced by known methods such as pulverization methods and polymerization methods. In a typical pulverization method, toner materials are melt-kneaded, the melt-kneaded product is cooled and pulverized into particles, and the particles are classified by size, thus preparing mother particles. To more improve transferability and durability, an external additive is added to the mother particles, thus obtaining a toner.

Specific examples of the kneader for kneading the raw materials of the toner include, but are not limited to, a batch-type double roll mill; Banbury mixer; double-axis continuous extruders such as TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KEX EXTRUDER (from Kurimoto, Ltd.); and single-axis continuous extruders such as KOKNEADER (from Buss Corporation).

The melt-kneaded product cooled may be coarsely pulverized by a HAMMER MILL or a ROTOPLEX and thereafter finely pulverized by a jet-type pulverizer or a mechanical pulverizer. Preferably, the pulverization is performed such that the resulting particles have an average particle diameter of from 3 to 15 μm.

When classifying the pulverized melt-kneaded product, a wind-power classifier may be used. Preferably, the classification is performed such that the resulting mother particles have an average particle diameter of from 5 to 20 μm.

The external additive is added to the mother particles by being mixed therewith by a mixer, so that the external additive gets adhered to the surfaces of the mother particles while being pulverized.

Specific examples of the binder resin include, but are not limited to, homopolymers of styrene or styrene derivatives (e.g., polystyrene, poly-p-styrene, polyvinyl toluene), styrene-based copolymers (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer), polymethyl methacrylate, polybutyl methacrylate, polyvinyl chloride, polyvinyl acetate, polyethylene, polyester, polyurethane, epoxy resin, polyvinyl butyral, polyacrylic acid, rosin, modified rosin, terpene resin, phenol resin, aliphatic or aromatic hydrocarbon resin, and aromatic petroleum resin. Two or more of these resins can be used in combination.

Specific examples of usable binder resins for pressure fixing include, but are not limited to: polyolefins (e.g., low-molecular-weight polyethylene, low-molecular-weight polypropylene), olefin copolymers (e.g., ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer, ionomer resin), epoxy resin, polyester resin, styrene-butadiene copolymer, polyvinyl pyrrolidone, methyl vinyl ether-maleic acid anhydride copolymer, maleic-acid-modified phenol resin, and phenol-modified terpene resin. Two or more of these resins can be used in combination.

Specific examples of the colorant (i.e., pigments and dyes) include, but are not limited to, yellow pigments such as Cadmium Yellow, Mineral Fast Yellow, Nickel Titanium Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake; orange pigments such as Molybdenum Orange, Permanent Orange GTR, Pyrazolone Orange, Vulcan Orange, Indanthrene Brilliant Orange RK, Benzidine Orange G, and Indanthrene Brilliant Orange GK; red pigments such as Red Iron Oxide, Cadmium Red, Permanent Red 4R, Lithol Red, Pyrazolone Red, Watching Red calcium salt, Lake Red D, Brilliant Carmine 6B, Eosin Lake, Rhodamine Lake B, Alizarin Lake, and Brilliant Carmine 3B; violet pigments such as Fast Violet B and Methyl Violet Lake; blue pigments such as Cobalt Blue, Alkali Blue, Victoria Blue lake, Phthalocyanine Blue, Metal-free Phthalocyanine Blue, partial chlorination product of Phthalocyanine Blue, Fast Sky Blue, and Indanthrene Blue BC; green pigments such as Chrome Green, chrome oxide, Pigment Green B, and Malachite Green Lake; and black pigments such as azine dyes (e.g., carbon black, oil furnace black, channel black, lamp black, acetylene black, aniline black), metal salt azo dyes, metal oxides, and combined metal oxides. Two or more of these colorants can be used in combination.

Specific examples of the release agent include, but are not limited to, polyolefins (e.g., polyethylene, polypropylene), fatty acid metal salts, fatty acid esters, paraffin waxes, amide waxes, polyvalent alcohol waxes, silicone varnishes, carnauba waxes, and ester waxes. Two or more of these materials can be used in combination.

The toner may further contain a charge controlling agent. Specific examples of the charge controlling agent include, but are not limited to: nigrosine; azine dyes having an alkyl group having 2 to 16 carbon atoms; basic dyes such as C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. 1. Basic Blue 24 (C. I. 52030), C. 1. Basic Blue 25 (C. I. 52025), C. 1. Basic Blue 26 (C. I. 44045), C. I. Basic Green 1 (C. I. 42040), and C. I. Basic Green 4 (C. I. 42000); lake pigments of these basic dyes; quaternary ammonium salts such as C. I. Solvent Black 8 (C. I. 26150), benzoylmethylhexadecyl ammonium chloride, and decyltrimethyl chloride; dialkyl (e.g., dibutyl, dioctyl) tin compounds; dialkyl tin borate compounds; guanidine derivatives; polyamine resins such as vinyl polymers having amino group and condensed polymers having amino group; metal complex salts of monoazo dyes; metal complexes of salicylic acid, dialkyl salicylic acid, naphthoic acid, and dicarboxylic acid with Zn, Al, Co, Cr, and Fe; sulfonated copper phthalocyanine pigments; organic boron salts; fluorine-containing quaternary ammonium salts; and calixarene compounds. Two or more of these materials can be used in combination. For color toners other than black toner, metal salts of salicylic acid derivatives, which are white, are preferable.

Specific examples of the external additive include, but are not limited to: inorganic particles such as silica, titanium oxide, alumina, silicon carbide, silicon nitride, and boron nitride; and resin particles such as polymethyl methacrylate particles and polystyrene particles having an average particle diameter of from 0.05 to 1 μm, obtainable by soap-free emulsion polymerization. Two or more of these materials can be used in combination. Among these, metal oxide particles (e.g., silica, titanium oxide) whose surfaces are hydrophobized are preferable. When a hydrophobized silica and a hydrophobized titanium oxide are used in combination with the amount of the hydrophobized titanium oxide greater than that of the hydrophobized silica, the toner provides excellent charge stability regardless of humidity.

The carrier according to an embodiment of the present invention can be used for a developer for replenishment that contains the carrier and a toner. This developer for replenishment can be applied to an image forming apparatus which forms an image while discharging surplus developer in the developing device, for reliably providing high image quality for an extremely extended period of time. This is because the deteriorated carrier particles in the developing device are replaced with non-deteriorated carrier particles contained in the developer for replenishment. Thus, the amount of charge is kept constant and images are reliably produced for an extended period of time. Such a system is particularly advantageous for printing an image with a high image area occupancy. When printing an image having a high image area occupancy, generally, the charge of the carrier particles get deteriorated as spent toner particles get adhered to the carrier particles. By contrast, in the above system, a large amount of carrier particles are supplied when printing an image having a high image area occupancy, and deteriorated carrier particles can be more frequently replaced with non-deteriorated carrier particles. Accordingly, high image quality is reliably provided for an extremely extended period of time.

Preferably, the developer for replenishment contains 2 to 50 parts by mass of the toner with respect to 1 part by mass of the carrier. When the amount of the toner is 2 parts by mass or more, the supplied amount of the carrier is not too large and the carrier concentration in the developing device is not too high. Therefore, the amount of charge of the developer is unlikely to increase. As the amount of charge of the developer increases, the developing ability deteriorates and the image density lowers. When the amount of the toner is 50 parts by mass or less, the proportion of the carrier in the developer for replenishment is not too small. Therefore, replacement of the carrier particles gets more frequent in the image forming apparatus, which is an effective measure against deterioration of carrier.

Preferably, the toner concentration in the two-component developer is in the range of from 4% to 9% by mass. When the toner concentration is 4% by mass or more, the amount of toner is large and an appropriate image density can be obtained. When the toner concentration is 9% by mass or less, the toner is easily held by the carrier and toner scattering is less likely to occur.

Image Forming Method

An image forming method according to an embodiment of the present invention includes the processes of: forming an electrostatic latent image on an electrostatic latent image bearer; developing the electrostatic latent image formed on the electrostatic latent image bearer with the two-component developer according to an embodiment of the present invention to form a toner image; transferring the toner image formed on the electrostatic latent image bearer onto a recording medium; and fixing the toner image on the recording medium.

Process Cartridge

A process cartridge according to an embodiment of the present invention includes: an electrostatic latent image bearer; a charger configured to charge a surface of the electrostatic latent image bearer; a developing device containing the two-component developer according to an embodiment of the present invention, configured to develop an electrostatic latent image formed on the electrostatic latent image bearer with the two-component developer; and a cleaner configured to clean the electrostatic latent image bearer.

Figure 3:
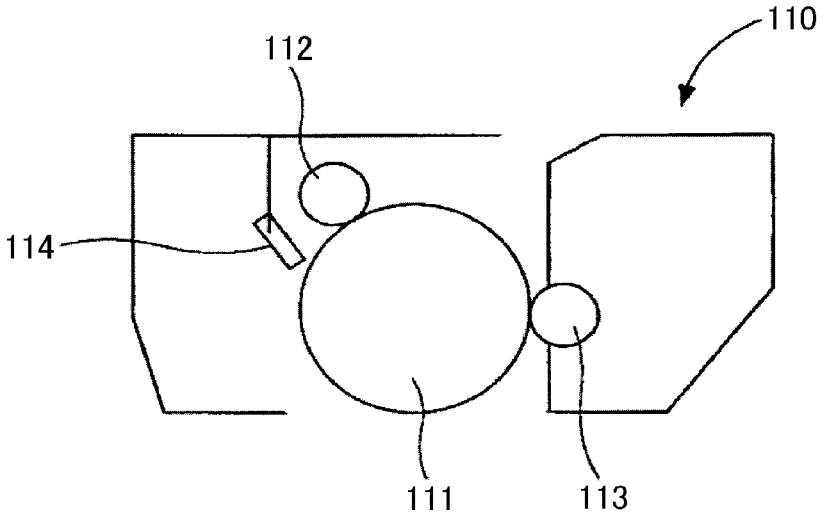
FIG. 3 is a schematic view of a process cartridge according to an embodiment of the present invention.

The process cartridge according to an embodiment of the present invention is illustrated in FIG. 3. A process cartridge 110 includes: a photoconductor 111 serving as an electrostatic latent image bearer; a charger 112 configured to charge the photoconductor 111; a developing device 113 containing the developer according to an embodiment of the present invention, configured to develop the electrostatic latent image formed on the photoconductor 111 with the developer to form a toner image; and a cleaner 114 configured to remove residual toner remaining on the photoconductor 111 after the toner image formed on the photoconductor 111 has been transferred onto a recording medium. The process cartridge 110 is detachably mountable on image forming apparatuses such as copiers and printers.

An image forming apparatus on which the process cartridge 110 is mounted forms images in the following manner. First, the photoconductor 111 is driven to rotate at a certain peripheral speed. The circumferential surface of the photoconductor 111 is uniformly charged to a certain positive or negative potential by the charger 112. The charged circumferential surface of the photoconductor 111 is irradiated with exposure light emitted from an exposure device (e.g., slit exposure device, scanning exposure device with laser beam), and an electrostatic latent image is formed thereon. The electrostatic latent image formed on the circumferential surface of the photoconductor 111 is developed with the developer according to an embodiment of the present invention by the developing device 113 to form a toner image. The toner image formed on the circumferential surface of the photoconductor 111 is transferred onto a transfer sheet that is fed to between the photoconductor 111 and a transfer device from a sheet feeder in synchronization with rotation of the photoconductor 111. The transfer sheet having the toner image thereon is separated from the circumferential surface of the photoconductor 111 and introduced into a fixing device. The toner image is fixed on the transfer sheet in the fixing device and then output as a copy from the image forming apparatus. On the other hand, after the toner image has been transferred, the surface of the photoconductor 111 is cleaned by removing residual toner by the cleaner 114 and then neutralized by a neutralizer, so that the photoconductor 111 gets ready for a next image forming operation.

Image Forming Apparatus

An image forming apparatus according to an embodiment of the present invention includes: an electrostatic latent image bearer; a charger configured to charge the electrostatic latent image bearer; an irradiator configured to form an electrostatic latent image on the electrostatic latent image bearer; a developing device containing the two-component developer according to an embodiment of the present invention, configured to develop the electrostatic latent image formed on the electrostatic latent image bearer with the two-component developer to form a toner image; a transfer device configured to transfer the toner image formed on the electrostatic latent image bearer onto a recording medium; and a fixing device configured to fix the toner image on the recording medium. The image forming apparatus may further include other devices such as a neutralizer, a cleaner, a recycler, and a controller, as necessary.

Figure 4:
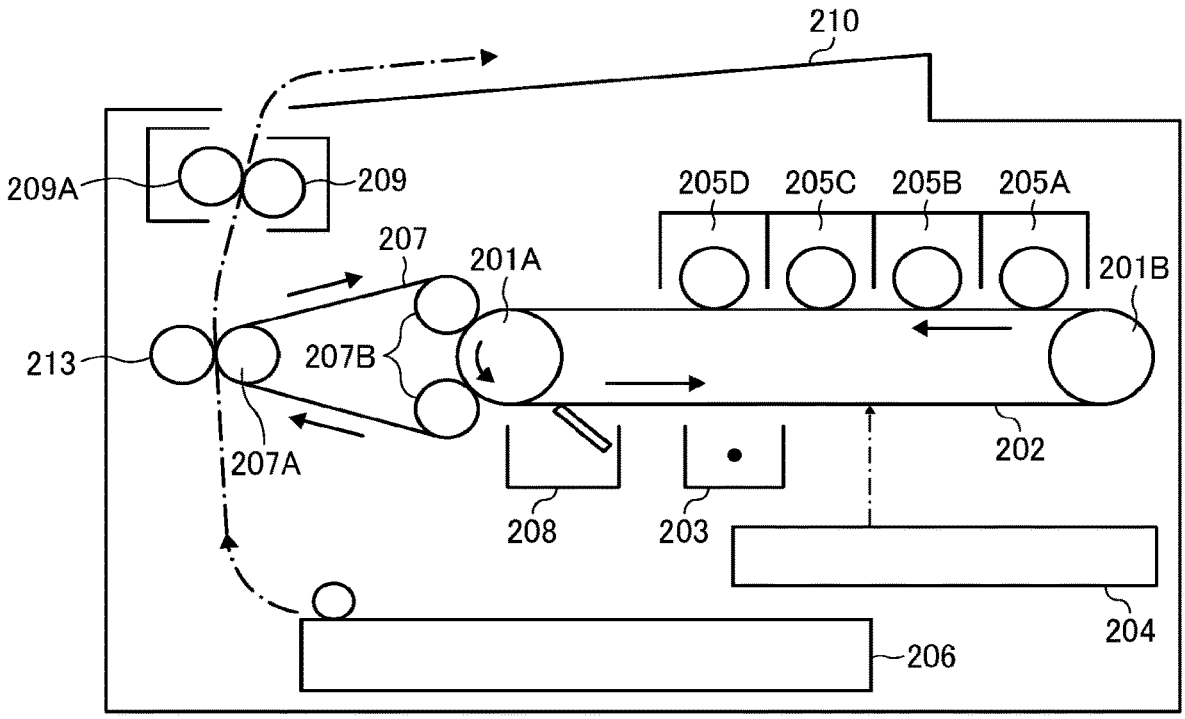
FIG. 4 is a schematic view illustrating an image forming apparatus according to an embodiment of the present invention.

FIG. 4 is a schematic view illustrating an image forming apparatus according to an embodiment of the present invention.

The image forming apparatus illustrated in FIG. 4 includes a driving roller 201A, a driven roller 201B, a photoconductor belt 202 (serving as the electrostatic latent image bearer), a charger 203, a laser writing unit 204 (serving as the irradiator), developing units 205A, 205B, 205C, and 205D (serving as the developing device) respectively containing yellow, magenta, cyan, and black toners, a sheet feeding tray 206, an intermediate transfer belt 207 (serving as the transfer device), a driving axial roller 207A for driving the intermediate transfer belt, a pair of driven axial rollers 207B for supporting the intermediate transfer belt, a cleaner 208, a fixing roller 209 and a pressure roller 209A (serving as the fixing device), a sheet output tray 210, and a sheet transfer roller 213.

The intermediate transfer belt 207 is stretched taut by the driving axial roller 207A and the pair of driven axial rollers 207B and endlessly conveyed clockwise in FIG. 4. A portion of the surface of the intermediate transfer belt 207 lying between the driven rollers 207B abuts the photoconductor belt 202 in a horizontal direction on the circumferential surface of the driving roller 201A.

In a normal color image output operation, each color toner image formed on the photoconductor belt 202 is transferred onto the intermediate transfer belt 207 each time of formation. The resulting composite color toner image is transferred onto a transfer sheet fed from the sheet feeding tray 206 by the sheet transfer roller 203. The transfer sheet having the transferred composite color toner image thereon is fed to between the fixing roller 209 and the pressure roller 209A so that the composite color toner image is fixed thereon. The transfer sheet is then output onto the sheet output tray 210.

EXAMPLES

Further understanding can be obtained by reference to certain specific examples which are provided herein for the purpose of illustration only and are not intended to be limiting. In the following descriptions, "parts" represents "parts by mass" and "%" represents "% by mass" unless otherwise specified.

Production Example 1

Composition of Resin Liquid 1

- Acrylic resin solution (having a solid content concentration of 20%): 200 parts
- Silicone resin solution (having a solid content concentration of 40%): 2,000 parts
- Aminosilane (having a solid content concentration of 100%): 30 parts
- Alumina surface-treated with tungsten-oxide-doped tin oxide (WTO) (having a powder specific resistivity of 40 Ω·m): 1,000 parts
- Barium sulfate (having an average particle diameter of 0.60 μm): 1,000 parts
- Toluene: 6,000 parts The above materials were subjected to a dispersion treatment using a HOMOMIXER for 10 minutes, thus obtaining a resin liquid 1 for forming a resin layer. Cu—Zn ferrite particles having a volume average particle diameter of 35 μm serving as core particles got coated with the resin liquid 1 by a SPIRA COTA SP-40 (manufactured by Okada Seiko Co., Ltd.) at a rate of 30 g/min in an atmosphere having a temperature of 60 degrees C., followed by drying, so that the resulting coating layer had a thickness of 0.50 μm. The SPIRA COTA is a fluidized bed coating apparatus employing a top spray system in which the spraying direction of the spray coating nozzle is from top to bottom. The coating was performed under the condition that the ratio (Mp/Mq) of the quantity Mp ($m^3$/min) of the supply air to the quantity Mq ($m^3$/min) of the secondary air was 1.85. The core particles having the coating layer thereon were burnt in an electric furnace at 230 degrees C. for 1 hour, then cooled, and pulverized with a sieve having an opening of 100 μm. Thus, a carrier 1 was prepared. The average thickness T, which is the average distance between the surface of the core particle and the surface of the coating layer, was 0.50 μm. The total amount of particles contained in 100 parts of the carrier coating resin was 238 parts.

The volume average particle diameter of the core particles was measured by a particle size analyzer MICROTRAC SRA (manufactured by Nikkiso Co., Ltd.) while setting the measuring range to between 0.7 μm and 125 μm.

The average thickness T (μm) that is the average distance between the surface of the core particle and the surface of the coating layer was determined by observing a cross-section of the carrier particle with a transmission electron microscope (TEM), measuring the distance between the surface of the core particle and the surface of the coating layer at 50 points along the surface of the carrier particle at intervals of 0.2 μm, and averaging the measured values.

Production Example 2

Composition of Resin Liquid 2

- Acrylic resin solution (having a solid content concentration of 20%): 200 parts
- Silicone resin solution (having a solid content concentration of 40%): 2,000 parts
- Aminosilane (having a solid content concentration of 100%): 30 parts
- Alumina surface-treated with tungsten-oxide-doped tin oxide (WTO) (having a powder specific resistivity of 40 Ω·m): 800 parts
- Barium sulfate (having an average particle diameter of 0.60 μm): 860 parts
- Toluene: 6,000 parts A carrier 2 was prepared in the same manner as in Production Example 1 except that the resin liquid 1 was replaced with the resin liquid 2. The total amount of particles contained in 100 parts of the carrier coating resin was 198 parts.

Production Example 3

Composition of Resin Liquid 3

- Acrylic resin solution (having a solid content concentration of 20%): 200 parts
- Silicone resin solution (having a solid content concentration of 40%): 2,000 parts
- Aminosilane (having a solid content concentration of 100%): 30 parts
- Alumina surface-treated with tungsten-oxide-doped tin oxide (WTO) (having a powder specific resistivity of 40 Ω·m): 1,415 parts
- Barium sulfate (having an average particle diameter of 0.60 μm): 1,500 parts
- Toluene: 6,000 parts A carrier 3 was prepared in the same manner as in Production Example 1 except that the resin liquid 1 was replaced with the resin liquid 3. The total amount of particles contained in 100 parts of the carrier coating resin was 347 parts.

Production Example 4

The carrier 1 prepared in Production Example 1 was sieved with a mesh having an opening of 25 μm. Thus, carrier particles 1-A were prepared, from which carrier particles D1 having a particle diameter of 25 μm or less had been removed. Next, a carrier 1-B was prepared in the same manner as in Production Example 1 except that the amount of the resin liquid 1 was adjusted so that the thickness of the coating layer became 0.4 μm. The carrier 1-B was then sieved with a mesh having an opening of 25 μm to collect carrier particles 1-C having a particle diameter of 25 μm or less. The carrier particles 1-A were well mixed with the same amount of the carrier particles 1-C as the carrier particles D1. Thus, a carrier 4 was prepared.

Production Example 5

A carrier 5 was prepared in the same manner as in Production Example 1 except that, in the fluidized bed coating apparatus, the top spray system in which the spraying direction of the spray coating nozzle was from top to bottom was replaced with another system in which the spraying direction was horizontal to the bottom of the apparatus and coincident with a direction from the wall surface to the inside of the apparatus.

Production Example 6

A carrier 6 was prepared in the same manner as in Production Example 1 except that the barium sulfate was replaced with a magnesium oxide (having an average particle diameter of 0.55 μm).

Production Example 7

A carrier 7 was prepared in the same manner as in Production Example 1 except that the barium sulfate was replaced with a magnesium hydroxide (having an average particle diameter of 0.61 μm)

Production Example 8

A carrier 8 was prepared in the same manner as in Production Example 1 except that the barium sulfate was replaced with a hydrotalcite (having an average particle diameter of 0.58 μm).

Production Example 9

A carrier 9 was prepared in the same manner as in Production Example 1 except that the barium sulfate was replaced with a zinc oxide (having an average particle diameter of 0.65 μm).

Comparative Production Example 1

Composition of Resin Liquid 10

- Acrylic resin solution (having a solid content concentration of 20%): 200 parts
- Silicone resin solution (having a solid content concentration of 40%): 2,000 parts
- Aminosilane (having a solid content concentration of 100%): 30 parts
- Alumina surface-treated with tungsten-oxide-doped tin oxide (WTO) (having a powder specific resistivity of 40 Ω·m): 800 parts
- Barium sulfate (having an average particle diameter of 0.60 μm): 810 parts
- Toluene: 6,000 parts A carrier 10 was prepared in the same manner as in Production Example 1 except that the resin liquid 1 was replaced with the resin liquid 10. The total amount of particles contained in 100 parts of the carrier coating resin was 192 parts.

Comparative Production Example 2

Composition of Resin Liquid 11

- Acrylic resin solution (having a solid content concentration of 20%): 200 parts
- Silicone resin solution (having a solid content concentration of 40%): 2,000 parts
- Aminosilane (having a solid content concentration of 100%): 30 parts
- Alumina surface-treated with tungsten-oxide-doped tin oxide (WTO) (having a powder specific resistivity of 40 Ω·m): 1,490 parts
- Barium sulfate (having an average particle diameter of 0.60 μm): 1,600 parts
- Toluene: 6,000 parts A carrier 11 was prepared in the same manner as in Production Example 1 except that the resin liquid 1 was replaced with the resin liquid 11. The total amount of particles contained in 100 parts of the carrier coating resin was 368 parts.

Comparative Production Example 3

The carrier 1 prepared in Production Example 1 was sieved with a mesh having an opening of 25 μm. Thus, carrier particles 1-A were prepared, from which carrier particles D1 having a particle diameter of 25 μm or less had been removed. Next, a carrier 1-E was prepared in the same manner as in Production Example 1 except that the amount of the resin liquid 1 was adjusted so that the thickness of the coating layer became 0.35 μm. The carrier 1-E was then sieved with a mesh having an opening of 25 μm to collect carrier particles 1-F having a particle diameter of 25 μm or less. The carrier particles 1-A were well mixed with the same amount of the carrier particles 1-F as the carrier particles D1. Thus, a carrier 12 was prepared.

Comparative Production Example 4

A carrier 13 was prepared in the same manner as in Production Example 1 except that, in the fluidized bed coating apparatus: the top spray system in which the spraying direction of the spray coating nozzle was from top to bottom was replaced with another system in which the spraying direction was horizontal to the bottom of the apparatus and coincident with a direction from the wall surface to the inside of the apparatus; the quantity of each airflow to be introduced was uniformly reduced by 10%; and the ratio (Mp/Mq) of the quantity Mp ($m^3$/min) of the supply air to the quantity Mq ($m^3$/min) of the secondary air was changed to 1.68.

Properties of the above-prepared carriers are presented in Table 1.

TABLE 1

| | Carrier name | Total amount of inorganic particles per 100 parts of coating resin (parts) | Constituent element variation in particles A in D1 with respect to D2 (%) | Particles A | Particles B |
|---|---|---|---|---|---|
| Example 1 | 1 | 238 | 1.4 | Barium sulfate | WTO-treated alumina |
| Example 2 | 2 | 198 | −0.3 | Barium sulfate | WTO-treated alumina |
| Example 3 | 3 | 347 | 4.7 | Barium sulfate | WTO-treated alumina |
| Example 4 | 4 | 238 | −9.8 | Barium sulfate | WTO-treated alumina |
| Example 5 | 5 | 238 | 9.5 | Barium sulfate | WTO-treated alumina |
| Example 6 | 6 | 238 | 1.2 | Magnesium oxide | WTO-treated alumina |
| Example 7 | 7 | 238 | 1.5 | Magnesium hydroxide | WTO-treated alumina |
| Example 8 | 8 | 238 | 1.5 | Hydrotalcite | WTO-treated alumina |
| Example 9 | 9 | 238 | 1.3 | Zinc oxide | WTO-treated alumina |
| Comparative Example 1 | 10 | 192 | −2.1 | Barium sulfate | WTO-treated alumina |
| Comparative Example 2 | 11 | 368 | 5.6 | Barium sulfate | WTO-treated alumina |
| Comparative Example 3 | 12 | 238 | −10.7 | Barium sulfate | WTO-treated alumina |
| Comparative Example 4 | 13 | 238 | 10.6 | Barium sulfate | WTO-treated alumina |

Toner Production Example

Synthesis of Polyester Resin A

In a reaction vessel equipped with a condenser tube, a stirrer, and a nitrogen introducing tube, 65 parts of ethylene oxide 2-mol adduct of bisphenol A, 86 parts of propylene oxide 3-mol adduct of bisphenol A, 274 parts of terephthalic acid, and 2 parts of dibutyltin oxide were put and allowed to react at 230 degrees C. under normal pressure for 15 hours. The reaction was further continued under reduced pressures of from 5 to 10 mmHg for 6 hours. Thus, a polyester resin A was prepared. The polyester resin A had a number average molecular weight (Mn) of 2,300, a weight average molecular weight (Mw) of 8,000, a glass transition temperature (Tg) of 58 degrees C., an acid value of 25 mgKOH/g, and a hydroxyl value of 35 mgKOH/g.

Synthesis of Prepolymer (Polymer Reactive with Compound Having Active Hydrogen Group)

In a reaction vessel equipped with a condenser tube, a stirrer, and a nitrogen introducing tube, 682 parts of ethylene oxide 2-mol adduct of bisphenol A, 81 parts of propylene oxide 2-mol adduct of bisphenol A, 283 parts of terephthalic acid, 22 parts of trimellitic anhydride, and 2 parts of dibutyltin oxide were put and allowed to react at 230 degrees C. under normal pressure for 8 hours. The reaction was further continued under reduced pressures of from 10 to 15 mmHg for 5 hours. Thus, an intermediate polyester was prepared.

The intermediate polyester had a number average molecular weight (Mn) of 2,100, a weight average molecular weight (Mw) of 9,600, a glass transition temperature (Tg) of 55 degrees C., an acid value of 0.5, and a hydroxyl value of 49.

In a reaction vessel equipped with a condenser tube, a stirrer, and a nitrogen introducing tube, 411 parts of the intermediate polyester, 89 parts of isophorone diisocyanate, and 500 parts of ethyl acetate were put and allowed to react at 100 degrees C. for 5 hours, thus preparing a prepolymer (i.e., polymer reactive with a compound having an active hydrogen group).

The proportion of free isocyanate in the prepolymer was 1.60% by mass. The solid content concentration of the prepolymer was 50% by mass (when measured at 150 degrees C. after leaving the prepolymer to stand for 45 minutes).

Synthesis of Ketimine (Compound Having Active Hydrogen Group)

In a reaction vessel equipped with a stirrer and a thermometer, 30 parts of isophoronediamine and 70 parts of methyl ethyl ketone were put and allowed to react at 50 degrees C. for 5 hours. Thus, a ketimine compound (i.e., the compound having an active hydrogen group) was prepared.

The ketimine compound (i.e., the compound having an active hydrogen group) had an amine value of 423.

Preparation of Master Batch

First, 1,000 parts of water, 540 parts of a carbon black PRINTEX 35 (manufactured by Degussa) having a DBP oil absorption amount of 42 mL/100 g and a pH of 9.5, and 1,200 parts of the polyester resin A were mixed with a HENSCHEL MIXER (manufactured by Mitsui Mining Co., Ltd.). Next, the resulted mixture was kneaded by a two-roll extruder at 150 degrees C. for 30 minutes, cooled by rolling, and pulverized by a pulverizer (manufactured by Hosokawa Micron Corporation). Thus, a master batch was prepared.

Preparation of Aqueous Medium

An aqueous medium was prepared by dissolving 265 parts of a 10% by mass suspension of tricalcium phosphate and 1.0 part of sodium dodecylbenzenesulfonate in 306 parts of ion-exchange water by uniformly mixing and stirring them.

Measurement of Critical Micelle Concentration

The critical micelle concentration of surfactants was measured in the following manner. An analysis was performed using an analysis program installed in the system of a surface tensiometer SIGMA (manufactured by Biolin Scientific). A surfactant was dropped in the aqueous medium with each drop having a proportion of 0.01% to the aqueous medium. After the aqueous medium had been stirred and allowed to stand, the interfacial tension was measured. From the resulted surface tension curve, the surfactant concentration above which the interfacial tension did not decrease even when the surfactant was further dropped was calculated as the critical micelle concentration. The critical micelle concentration of sodium dodecylbenzenesulfonate with respect to the aqueous medium, measured with the surface tensiometer SIGMA, was 0.05% with respect to the mass of the aqueous medium.

Preparation of Toner Material Liquid

In a beaker, 70 parts of the polyester resin A and 10 parts of the prepolymer were dissolved in 100 parts of ethyl acetate by stirring. Further, 5 parts of a paraffin wax (HNP-9 manufactured by Nippon Seiro Co., Ltd., having a melting point of 75 degrees C.) as a release agent, 2 parts of MEK-ST (manufactured by Nissan Chemical Corporation), and 10 parts of the master batch were added to the beaker and subjected to a dispersing treatment using a bead mill (ULTRAVISCOMILL manufactured by Aimex Co., Ltd.) filled with 80% by volume of zirconia beads having a particle diameter of 0.5 mm at a liquid feeding speed of 1 kg/hour and a disc peripheral speed of 6 m/sec. After performing this dispersing operation 3 times (3 passes), 2.7 parts of the ketimine was dissolved therein. Thus, a toner material liquid was prepared.

Preparation of Emulsion or Liquid Dispersion

In a vessel, 150 parts of the aqueous medium was stirred by a TK HOMOMIXER (manufactured by Primix Corporation) at a revolution of 12,000 rpm, and 100 parts of the toner material liquid were added thereto and mixed for 10 minutes. Thus, an emulsion or liquid dispersion (hereinafter "emulsion slurry") was prepared.

Removal of Organic Solvent

In a flask equipped with a stirrer and a thermometer, 100 parts of the emulsion slurry was placed and stirred at a stirring peripheral speed of 20 m/min at 30 degrees C. for 12 hours to remove the solvent. Thus, a dispersion slurry was prepared.

Washing

First, 100 parts of the dispersion slurry were filtered under reduced pressures. The resulted filter cake was mixed with 100 parts of ion-exchange water by a TK HOMOMIXER (at a revolution of 12,000 rpm for 10 minutes) and then filtered. The resulted filter cake was mixed with 300 parts of ion-exchange water by a TK HOMOMIXER (at a revolution of 12,000 rpm for 10 minutes) and then filtered. This operation was repeated twice. The resulted filter cake was mixed with 20 parts of a 10% by mass aqueous solution of sodium hydroxide by a TK HOMOMIXER (at a revolution of 12,000 rpm for 30 minutes) and then filtered under reduced pressures. The resulted filter cake was mixed with 300 parts of ion-exchange water by a TK HOMOMIXER (at a revolution of 12,000 rpm for 10 minutes) and then filtered. The resulted filter cake was mixed with 300 parts of ion-exchange water by a TK HOMOMIXER (at a revolution of 12,000 rpm for 10 minutes) and then filtered. This operation was repeated twice. The resulted filter cake was mixed with 20 parts of a 10% by mass aqueous solution of hydrochloric acid by a TK HOMOMIXER (at a revolution of 12,000 rpm for 10 minutes) and then filtered.

Adjustment of Amount of Surfactant

The filter cake prepared in the above washing process was mixed with 300 parts of ion-exchange water by a TK HOMOMIXER (at a revolution of 12,000 rpm for 10 minutes) to prepare a toner dispersion liquid. The electrical conductivity of this toner dispersion liquid was measured and the surfactant concentration thereof was calculated with reference to the surfactant concentration calibration curve created in advance. The toner dispersion liquid was further added with ion-exchange water so that the calculated surfactant concentration became the target surfactant concentration of 0.05%.

Surface Treatment Process

The toner dispersion liquid adjusted to have the specified surfactant concentration was heated in a water bath at a heating temperature Ti of 55 degrees C. for 10 hours while being stirred at 5,000 rpm by a TK HOMOMIXER. The toner dispersion liquid was thereafter cooled to 25 degrees C. and then filtered. The resulted filter cake was mixed with 300 parts of ion-exchange water by a TK HOMOMIXER (at a revolution of 12,000 rpm for 10 minutes) and then filtered.

Drying

The resulted final filter cake was dried by a circulating air dryer at 45 degrees C. for 48 hours and then filtered with a mesh having an opening of 75 μm. Thus, mother toner particles 1 were prepared.

External Addition Treatment

Next, 100 parts of the mother toner particles 1 were mixed with 3.0 parts of a hydrophobic silica having an average particle diameter of 100 nm, 1.0 part of a titanium oxide having an average particle diameter of 20 nm, and 1.5 parts of a hydrophobic silica powder having an average particle diameter of 15 nm using a HENSCHEL MIXER. Thus, a toner 1 was prepared.

Preparation of Developer

Each of the above-prepared carriers 1 to 13 (93 parts) was mixed and stirred with the toner 1 (7 parts) by a TURBULA MIXER at a revolution of 81 rpm for 3 minutes. Thus, developers 1 to 13 were prepared for evaluation. Further, developers for replenishment corresponding to these developers were prepared with each carrier and the toner such that the toner concentration was 95%.

Developer Property Evaluations

The above-prepared developers 1 to 13 were subjected to the following evaluations.

To evaluate carrier deposition at the initial stage of printing free of scraping of the coating resin film, the following Developer Property Evaluation 1 was performed to evaluate carrier deposition at edge portions and solid portions in the initial stage. To evaluate resistance decrease with time during printing, the following Developer Property Evaluation 2 was performed to evaluate carrier deposition at edge portions and solid portions with time. To evaluate the charge imparting property to toner in a long time period, the following Developer Property Evaluation 3 was performed to evaluate toner scattering. A digital full-color multifunction peripheral (PRO C9100 manufactured by Ricoh Co., Ltd.), which was a high-speed color production printer, was used for the evaluations.

Developer Property Evaluation 1

Each of the above-prepared developers was put in a commercially-available digital full-color multifunction peripheral (PRO C9100 manufactured by Ricoh Co., Ltd.) for image evaluation as follows.

Carrier Deposition at Edge Portions

The above machine was placed in an environmental evaluation room (in a low-temperature and low-humidity environment of 10 degrees C., 15% RH) and left for one day, and each of the developers 1 to 13 was put therein to evaluate carrier deposition at edge portions.

Under a specific development condition (with a charging potential (Vd) of −630 V and a development bias DC of −500 V), an image in which solid portions and white-paper portions, each being a 170 μm×170 μm square, are laterally and longitudinally arranged in an alternating manner was output in A3 size. The number of white voids present at the boundary of the squares was counted as the number of carrier-deposited portions. In Table 2, A represents a state in which the number of carrier-deposited portions is 0, B represents a state in which the number of carrier-deposited portions is 1 to 3, C represents a state in which the number of carrier-deposited portions is 4 to 10, and D represents a state in which the number of carrier-deposited portions is 11 or more. A, B, and C are acceptable levels, and D is unacceptable level.

Carrier Deposition at Solid Portions

The above machine was placed in an environmental evaluation room (in an environment of 25 degrees C., 60% RH) and each of the developers 1 to 13 was put therein.

A process of forming a solid image under a specific development condition (with a charging potential (Vd) of −600 V, a potential of −100 Vat the portion corresponding to the image portion (solid portion) after exposure, and a development bias DC of −500 V) was conducted but interrupted by turning off the power supply, to count the number of carrier-deposited portions on the photoconductor after image transfer. Specifically, a 10 mm×100 mm area on the photoconductor was subjected to evaluation. In Table 2, A represents a state in which the number of carrier-deposited portions is 0, B represents a state in which the number of carrier-deposited portions is 1 to 3, C represents a state in which the number of carrier-deposited portions is 4 to 10, and D represents a state in which the number of carrier-deposited portions is 11 or more. A, B, and C are acceptable levels, and D is unacceptable level Developer Property Evaluation 2

Each of the above-prepared developers was put in a commercially-available digital full-color multifunction peripheral (PRO C9100 manufactured by Ricoh Co., Ltd.) for image evaluation as follows. Specifically, the above machine was placed in an environmental evaluation room (in an environment of 25 degrees C., 60% RH) and a running test in which an image having an image area rate of 0.5% was continuously produced on 1,000,000 sheets was performed using each of the developers 1 to 13 and those for replenishment. After completion of the running test, carrier deposition was evaluated at edge portions and solid portions. The evaluation was performed in the same manner as described above except for being performed after the running test on 1,000,000 sheets.

Developer Property Evaluation 3

Using a digital full-color multifunction peripheral (PRO C9100 manufactured by Ricoh Co., Ltd.) and each of the developers 1 to 13 and those for replenishment, a running test in which an image having an image area rate of 40% was continuously produced on 1,000,000 sheets was performed. After completion of the running test, toner scattering was evaluated.

Toner Scattering

After the running test on 1,000,000 sheets, the toner accumulated at lower part of the developer bearer was sucked and collected, and the mass thereof was measured. The evaluation criteria are as follows.

A (Very good): 0 mg or more and less than 50 mg

B (Good): 50 mg or more and less than 100 mg

C (Acceptable): 100 mg or more and less than 250 mg

D (Poor): 250 mg or more

The results of the image evaluation are presented in Table 2.

TABLE 2

| | Carrier name | Carrier deposition at edge portions in initial stage | Carrier deposition at solid portions in initial stage | Carrier deposition at edge portions over time | Carrier deposition at solid portions over time | Toner scattering |
|---|---|---|---|---|---|---|
| Example 1 | 1 | A | A | A | A | B |
| Example 2 | 2 | A | A | A | B | C |
| Example 3 | 3 | C | C | B | B | A |
| Example 4 | 4 | A | A | B | C | B |
| Example 5 | 5 | C | C | B | B | B |
| Example 6 | 6 | B | B | B | B | B |
| Example 7 | 7 | B | B | B | B | B |
| Example 8 | 8 | B | B | B | B | B |
| Example 9 | 9 | B | B | B | A | B |
| Comparative Example 1 | 10 | A | A | B | D | D |
| Comparative Example 2 | 11 | D | D | B | B | A |
| Comparative Example 3 | 12 | A | A | D | D | B |
| Comparative | 13 | D | D | B | A | B |

TABLE 2-continued

| | Carrier name | Carrier deposition at edge portions in initial stage | Carrier deposition at solid portions in initial stage | Carrier deposition at edge portions over time | Carrier deposition at solid portions over time | Toner scattering |
|---|---|---|---|---|---|---|
| Example 4 | | | | | | |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A carrier for forming an electrophotographic image, comprising;

carrier particles each comprising:

a core particle; and a coating layer coating the core particle, the coating layer comprising:

a coating resin; and inorganic particles comprising chargeable particles A and conductive particles B, an amount of the inorganic particles being from 195 to 350 parts by mass with respect to 100 parts by mass of the coating resin, wherein the carrier particles consist of:

small carrier particles having a particle diameter of D1, where $D1 \leq 25$ μm is satisfied;

medium carrier particles having a particle diameter of D2, where 25 μm$<D2\leq$38 μm is satisfied; and large carrier particles having a particle diameter of D3, where 38 μm$<$D3 is satisfied, wherein a constituent element variation is within a range of from −10.0% to 10.0%, where the constituent element variation being a ratio of an amount of a constituent element of the inorganic particles contained in the coating layer of the small carrier particles having a particle diameter of D1 to an amount of the same constituent element of the inorganic particles contained in the coating layer of the medium carrier particles having a particle diameter of D2.

2. The carrier according to claim 1, wherein the chargeable particles A comprise at least one member selected from the group consisting of barium sulfate, magnesium oxide, magnesium hydroxide, and hydrotalcite.

3. The carrier according to claim 1, wherein the conductive particles B comprise a tin oxide doped with at least one member selected from the group consisting of tungsten, indium, phosphorous, and oxides of tungsten, indium, and phosphorous.

4. The carrier according to claim 3, wherein the conductive particles B comprise:

base particles; and the tin oxide doped with said at least one member, disposed on surfaces of the base particles.

5. A two-component developer comprising:

the carrier according to claim 1; and a toner.

6. The two-component developer according to claim 5, wherein the toner is a negatively-chargeable toner.

7. The two-component developer according to claim 5, wherein the toner is a color toner.

8. A developer for replenishment, comprising:

the carrier according to claim 1 in an amount of 1 part by mass; and a toner in an amount of from 2 to 50 parts by mass or more.

9. An image forming apparatus comprising:

an electrostatic latent image bearer;

a charger configured to charge the electrostatic latent image bearer;

an irradiator configured to form an electrostatic latent image on the electrostatic latent image bearer;

a developing device containing the two-component developer according to claim 5, configured to develop the electrostatic latent image formed on the electrostatic latent image bearer with the two-component developer to form a toner image;

a transfer device configured to transfer the toner image formed on the electrostatic latent image bearer onto a recording medium; and a fixing device configured to fix the toner image on the recording medium.

10. A process cartridge comprising:

an electrostatic latent image bearer;

a charger configured to charge a surface of the electrostatic latent image bearer;

a developing device containing the two-component developer according to claim 5, configured to develop an electrostatic latent image formed on the electrostatic latent image bearer with the two-component developer; and a cleaner configured to clean the electrostatic latent image bearer.

11. An image forming method comprising:

forming an electrostatic latent image on an electrostatic latent image bearer;

developing the electrostatic latent image formed on the electrostatic latent image bearer with the two-component developer according to claim 5 to form a toner image;

transferring the toner image formed on the electrostatic latent image bearer onto a recording medium; and fixing the toner image on the recording medium.

* * * * *